United States Patent [19]

Murakami

[11] Patent Number: 4,789,879

[45] Date of Patent: Dec. 6, 1988

[54] COPIER FOR COMPOSITE COPYING WITH AUTOMATIC MAGNIFICATION ADJUSTING MEANS

[75] Inventor: Susumu Murakami, Osaka, Japan

[73] Assignee: Sharp Kabushiki Kaisha, Osaka, Japan

[21] Appl. No.: 13,907

[22] Filed: Feb. 12, 1987

[30] Foreign Application Priority Data

Feb. 20, 1986 [JP] Japan ..... 61-36037

[51] Int. Cl.[4] ..... G03G 15/00

[52] U.S. Cl. ..... 355/14 R; 355/55

[58] Field of Search ..... 355/8, 3 SH, 3 FU, 55-57, 355/14 R, 14 C

[56] References Cited

U.S. PATENT DOCUMENTS 4,573,789 3/1986 Wada ..... 355/8 X 4,575,227 3/1986 Ito et al. ..... 355/56

*Primary Examiner*—A. T. Grimley

*Assistant Examiner*—J. Pendegrass

*Attorney, Agent, or Firm*—Flehr, Hohbach, Test, Albritton & Herbert

[57] ABSTRACT

A copier includes a device for automatically correcting the magnification according to the change in size of the copy paper caused by the preceding copying process effected thereon such that, when the copier is used in a composite mode of operation, images transferred on the paper from different processes have the same size and aligned correctly.

5 Claims, 2 Drawing Sheets

COPIER FOR COMPOSITE COPYING WITH AUTOMATIC MAGNIFICATION ADJUSTING MEANS

BACKGROUND OF THE INVENTION

This invention relates to a copier adapted for composite copying whereby coping is effected twice or more on a single sheet of copy paper and more particularly to such a copier which automatically adjusts its magnification according to the change in size of the paper caused by the previous copying operation thereon.

In the case of a two-side copying process, an image is transferred first onto one side of the copy paper and then a similar process is repeated on the other side. In other words, copying is effected twice on a single sheet of copy paper. In the case of a composite copying process, copying is effected onto a part of the paper first and the same or another image is transferred onto another part on the same side of the paper. This is repeated any number of times. After each copying, however, the paper is passed through a fixing device to have the transferred image fixed. If the fixing process is carried out by a pressure fixing method, the paper tends to become stretched during the process but if it is done thermally, the paper tends to shrink.

In the case of such a multiple copying process, therefore, the effective magnification changes after each copying process because of the change in the size of the processed copy paper. This means that the obtained image may appear distorted, mismatched, or misaligned. No copier, however, has been developed to eliminate this problem.

SUMMARY OF THE INVENTION

It is therefore an object of the present invention to provide a copier adapted for compound copying which can prevent distortion, mismatching and misalignment of image caused by the stretching or shrinking of the copy paper.

The above and other objects of the present invention are achieved by providing a copier equipped with means for automatically effecting fine adjustments of magnification according to the change in size of the copy paper caused by each copying process. With a copier thus equipped, the image magnification can be increased or decreased by small degrees. After an initial copying process, therefore, the image magnification is changed in accordance with the resultant stretching or shrinking of the paper such that the second copying process can produce an image which matches and is well aligned with that obtained in the initial copying process. Distortion of the overall image and misalignment of individual images can thus be prevented.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
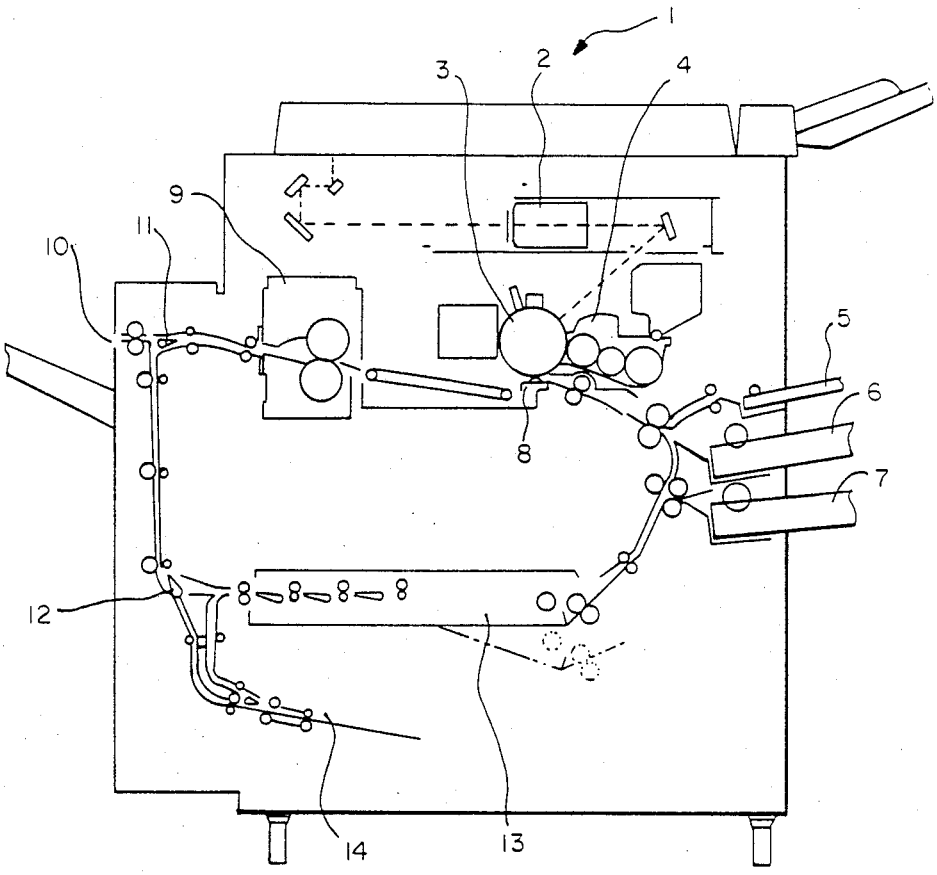
FIG. 1 is a schematic sectional view showing the internal structure of a copier embodying the present invention.

A copier embodying the present invention and a method of its operation are explained below by way of FIGS. 1, 2 and 3 but the present invention is not intended to be limited by this exemplary disclosure. With reference initially to FIG. 1, numeral 1 generally indicates a copier embodying the present invention which uses a zoom lens 2 to form an electrostatic latent image on a photosensitive body 3 and a developing device 4 to produce a visible image therefrom. The visible image thus formed is transferred at an image transfer position 8 onto a sheet of copy paper supplied from one of paper cassettes 5, 6 and 7. The transferred image is then fixed by a fixing device 9 and the copy paper is discharged through an outlet 10 in the case of a normal one-side copying mode of operation.

In the case of a composite copying mode of operation, guide pieces 11 and 12 are turned in counter-clockwise directions such that the paper leaving the fixing device 9 is led to an intermediate tray 13. When the operator then presses a COPY button (not shown), the paper in the intermediate tray 13, rather than a sheet in any of the cassettes 5, 6 and 7, is set at the image transfer position 8 and copying is effected on this same paper.

In the case of a two-side copying mode of operation, the first guide piece 11 turns in counter-clockwise direction but the second guide piece 12 turns in clockwise direction such that the paper leaving the fixing device 9 is led to a direction reversing section 14 which serves to change the direction of motion of the paper, effectively turning the paper upside down as the paper is subsequently led to the intermediate tray 13. When the operator presses the COPY button, the paper, now positioned upside down in the intermediate tray 13, is led to the image transfer position 8 and the next image is transferred onto the back side of the paper. After the two-side or composite copying is completed, the first guide piece 11 is turned in clockwise direction and serves to discharge the paper through the discharge outlet 10.

Figure 2:
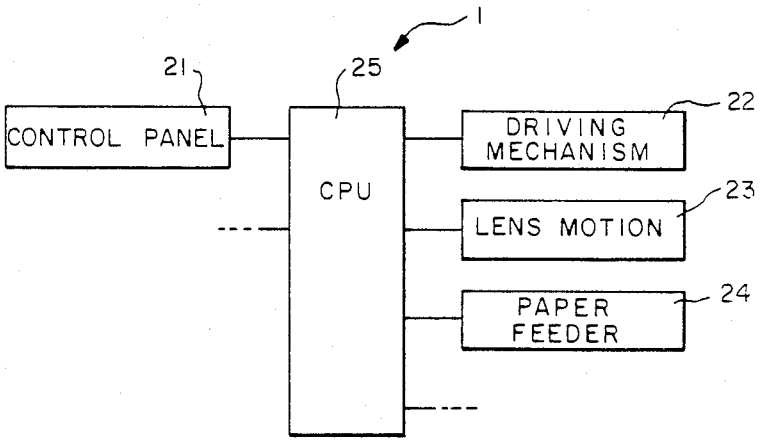
FIG. 2 is a block diagram of a principal part of the control system of the copier of FIG. 1.
Figure 3:
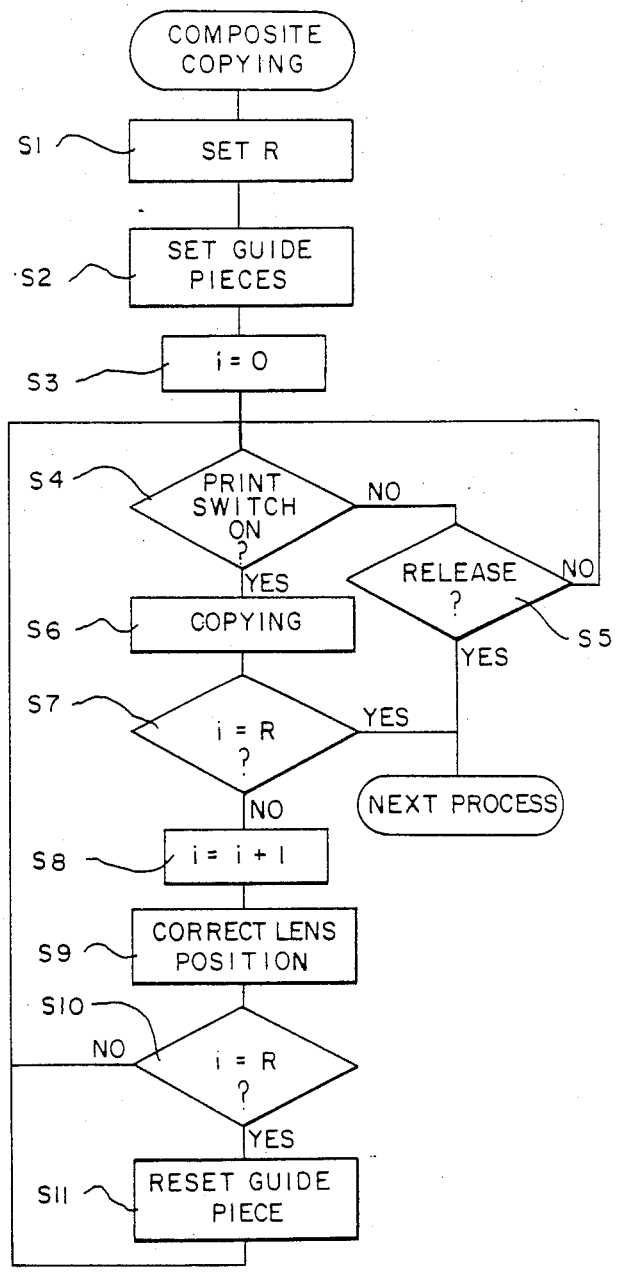
FIG. 3 is a flow chart of the operation for composite copying by using the copier of FIG. 1.

With reference next to FIG. 2 which describes a control system of the copier 1, numeral 21 indicates a control panel through which the operator controls the operation and includes the aforementioned COPY button, selection buttons for selecting a mode of operation such as composite copying, and numeric buttons. Numeral 22 generally indicates a driving mechanism section for moving mirrors and rotating the photosensitive body 3 for copying. Numeral 23 generally indicates a section for internal motion of the lens 2 for adjusting the image magnification. Numeral 24 generally indicates a paper feeding mechanism which transports paper in conjunction with the driving mechanism section 22 and also controls the motion of the guide pieces 11 and 12. Numeral 25 indicates a central processing unit including a microcomputer which controls each of the sections described above.

Operation of this copier 1 in the composite copying mode is explained next by way of FIG. 3. To start, the operator specifies on the control panel 21 the mode of operation and the number of times (frequency) copying must be repeated. Then, this frequency number R is set in a register (S1) and the guide pieces 11 and 12 are positioned for the composite mode of operation as explained above (S2). Next, a dummy variable i is set equal to zero (S3) and the system waits until the operator either presses the PRINT switch (YES in S4) or releases the mode selection (YES in S5), for example, by entering another mode selection command. If the PRINT switch is pressed, copying is started in a known manner (S6).

During the first copying process, the image magnification of the zoom lens 2 and scanning speed are set according to the command entered through the control panel 21 by the operator. After the printing process is completed, the dummy variable i is compared with R (S7). If i=R, this means that copying has been repeated as many times as desired and the system gets ready for the next processing. If i has not reached R, the value of i is increased by 1 (S8) and the magnification of the zoom lens 2 is corrected according to the new value of i. This may actually be accomplished by moving the zoom lens 2 by a distance d(i) corresponding to the value of i (S9). The distances d(i) by which the zoom lens 2 must be moved for best results may be predetermined, for example, as shown in Table 1 and stored preliminarily in a memory device for the central processing unit 25.

TABLE 1

| i | d(i) |
|---|---|
| 1 | 1.0 mm |
| 2 | 0.5 |
| 3 | 0.3 |
| 4 | 0.2 |
| 5 | 0.1 |
| 6 and over | 0.0 |

Since the fixing device 9 of the copier 1 of FIG. 1 uses a thermal fixing method, paper processed thereby tends to shrink from its original size and the image magnification of the zoom lens 2 is decreased accordingly. Since the paper shrinks by less than 1%, the correction of the magnification must also be less than 1%.

Next, the dummy variable i is compared with R (S10) to determine whether the copying process to be performed next is the last one before the paper is discharged. If i=R, this means that the paper should be discharged through the outlet 10 after the next copying process and the first guide piece 11 is rotated in clockwise direction (S11). If i has not reached R, the paper must be led back to the intermediate tray 13 again after the next copying process and hence the system returns from Step S10 to Step S4 with the guide pieces 11 and 12 left at the same positions. If the operator presses the PRINT switch at this point, copying is effected again on the same paper on which copying has already been done once and this is how composite copying is effected. This time, however, the image magnification is already corrected as described above and the scanning speed of mirrors, etc. are also adjusted according to the corrected magnification such that an image can be formed without introducing distortions, misalignment or the like caused by the change in size of the paper.

The two-side copying mode of operation can be carried out according to a sequence which is nearly identical to the one described above and hence will not be explained separately. The foregoing description of an embodiment of the invention has been presented for purposes of illustration and description. It is not intended to be exhaustive or to limit the invention to the precise form disclosed, and many modifications and variations are possible in light of the above teaching. For example, the copier mechanism may be simplified by only providing means for correcting the magnification. The present invention can also be applied to a copier not adapted for composite copying mode of operation. In such a case, a switch may be provided for effecting a fine adjustment of the magnification by which the operator can adjust the magnification according to the change in size of the copy paper when the operator returns the discharged paper back into the supply paper tray for copying for the second (or later) time. Such modifications and variations that may be apparent to a person skilled in the art are intended to be included within the scope of this invention.

What is claimed is:

1. In a copier adapted for composite copying, the improvement comprising means for effecting fine adjustments of magnification and means for automatically controlling said adjustment effecting means according to the change in size of copy paper caused by preceding copying process effected on said copy paper whereby non-uniformity in image size can be prevented when copying is effected twice or more on a single copy paper.

2. The copier of claim 1 further including a zoom lens, said means for effecting a fine adjustment serving to move said zoom lens by a distance determined by the number of times copying has been effected on said single copy paper.

3. The copier of claim 2 wherein said means for effecting a fine adjustment includes a microcomputer with memory means, said memory means storing data related to said distance.

4. A copier comprising a zoom lens and means for effecting fine adjustments of magnification according to the change in size of copy paper caused by preceding copying process effected on said copy paper, said adjustment effecting means serving to move said zoom lens by a distance determined by the number of times copying has been effected on said single copy paper whereby non-uniformity in image size can be prevented when copying is effected twice or more on a single copy paper.

5. The copier of claim 4 wherein said adjustment effecting means include a microcomputer with memory means, said memory means storing data related to said distance.

* * * * *